US011533965B1

(12) United States Patent
Zhao

(10) Patent No.: US 11,533,965 B1
(45) Date of Patent: Dec. 27, 2022

(54) SILICONE INSOLE

(71) Applicant: Dongguan Desheng Garment Technology Co., Ltd., Dongguan (CN)

(72) Inventor: Yong Zhao, Dongguan (CN)

(73) Assignee: DONGGUAN DESHENG GARMENT TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 17/833,897

(22) Filed: Jun. 7, 2022

(30) Foreign Application Priority Data

Feb. 24, 2022 (CN) ..... 202210172994.X

(51) Int. Cl.
*A43B 17/18* (2006.01)
*A43B 17/00* (2006.01)
*A43B 17/14* (2006.01)

(52) U.S. Cl.
CPC ..... *A43B 17/006* (2013.01); *A43B 17/14* (2013.01)

(58) Field of Classification Search
CPC ..... A43B 17/006
See application file for complete search history.

(56) References Cited

U.S. PATENT DOCUMENTS 2,641,068 A * 6/1953 Thompson ..... A43B 17/006 36/44
4,055,699 A * 10/1977 Hsiung ..... A43B 17/003 428/80
4,887,368 A * 12/1989 Latzke ..... B32B 15/046 36/43
8,069,587 B2 * 12/2011 Purrington ..... A43B 17/14 36/181
8,950,089 B2 * 2/2015 Youngs ..... A43B 13/12 36/137
10,045,590 B2 * 8/2018 Leiser ..... A43B 13/386
10,639,241 B1 * 5/2020 Torres ..... A61J 17/02
11,109,639 B2 * 9/2021 Shanker ..... B32B 27/285
2004/0103561 A1 * 6/2004 Campbell ..... A43B 23/17 36/155
2008/0229612 A1 * 9/2008 Sommer ..... A43B 17/102 36/43
2010/0083534 A1 * 4/2010 Howlett ..... A43B 3/26 36/43

(Continued)

*Primary Examiner* — Jila M Mohandesi
(74) *Attorney, Agent, or Firm* — Hemisphere Law, PLLC; Zhigang Ma

(57) ABSTRACT

A silicone insole is provided and includes a lower insole layer, a polymer adhesive layer, a surface treatment agent layer and an upper silicone flat layer sequentially arranged from bottom to top in that order, the upper silicone flat layer is made of a food-grade silicone, and an upper end surface of the upper silicone flat layer is a flat structure without grooves and protrusions. An overall connection of the silicone insole is more solid and durable. The silicone insole can disperse pressure on foot to be more suitable for long standing or sporting under a protection of the food-grade silicone, it is suitable for shoes needing insoles to improve performance, and makes full use of advantages of silicone materials such as high friction, waterproof, slightly air permeability, better absorb moisture and perspiration, soft, environmentally protection, non-toxic, odorless, guaranteed rebound touch, quality, ageing resistance, and anti-static.

6 Claims, 1 Drawing Sheet

(56) References Cited

U.S. PATENT DOCUMENTS

| | | | | |
|---|---|---|---|---|
| 2012/0047768 | A1* | 3/2012 | Brave | A43B 13/125<br>36/43 |
| 2012/0255101 | A1* | 10/2012 | Pizzo | A43B 1/0027<br>2/239 |
| 2017/0202300 | A1* | 7/2017 | Sherman | A43B 17/02 |
| 2021/0368911 | A1* | 12/2021 | Lucero | A43B 13/125 |

* cited by examiner

SILICONE INSOLE

TECHNICAL FIELD

The present disclosure relates to the technical field of daily necessities, and more particularly to a silicone insole.

BACKGROUND

Silicone is an excellent scientific and technological material, it has the following characteristics:

1. the silicone material shows excellent sealability, high temperature resistance, weatherability, ageing resistance, damage resistance, vibration resistance, waterproof, and it can fit all kinds of smooth surface materials;

2. the silicone material can be self-adhesive with a back glue to have better sealability, the back glue is high temperature resistant and will not fall off after long-term use, the silicone material has advantages of environmental protection, safety, good insulation, high temperature resistance, small compressive deformation, high elasticity, and non-toxic;

3. the silicone material has advantages such as environmental protection, non-toxic, odorless, good elasticity, good flexibility, no bubbles and no pores on surface, high strength, long service life, product insulation environmental protection, high and low temperature resistance, compression resistance, acid and alkali resistance, ageing resistance, and anti-ultraviolet;

4. flat surfaces, and evenly distributed force;

5. good non-stick surface and air permeability;

6. the silicone material is in line with environmental standards;

7. temperature resistance: −70° C. to 300° C.;

8. heat resistance: the silicone has better heat resistance than common rubbers and other foaming materials, it can be used almost forever at 150° C. without performance changes, can be used continuously 10000 hours under 200° C., and can be used for a period under 350° C.;

9. weatherability: in the harsh conditions inside the shoes, ordinary shoes which are made of rubber and chemical fiber fabric are easy to produce mixed odor and micro-toxic emission, etc. However, physical properties of the silicone will not have any physical and chemical changes under the force of human body; and 10. ageing and corrosion resistance, the silicone itself is highly inert.

The insole as a supplement and reinforcement of shoe function, it is becoming increasingly important in service, load-bearing, soft, force conduction, friction, anti-static, waterproof, air permeability, non-toxic, environmental protection, weatherability, ageing resistance, with the progress of life and the continuous development of science, people have more requirements for the insole.

Existing silicone insoles have great disadvantages:

1. the use of traditional molding pressure in the production process leads to low material utilization, waste of materials and high cost;

2. insufficient product design direction, using traditional ideas to design an insole with low front and high rear, which does not consider the consumption application scenario and whether the shape of the existing shoes is suitable;

3. understanding and excavation of the material characteristics are insufficient, the process development is rough, and the social scenarios and consumption applications are limited;

4. the existing silicone insole is soft, and is easy to be taken out when taking off the shoes, and it is extremely inconvenient to use;

5. the existing silicone insole is soft and thick, and is easy to deform the original shoes, resulting in damaging the shoes;

6. the existing insole has an uneven surface (in order to increase friction), which defines gaps when the foot contacts the insole, resulting in reducing the friction force of the insole;

7. the uneven insole surface reduces the contact area of force between the insole and the foot surface. Long-term use makes the sole of the foot maintain stress for a long time and it is easy to fatigue, producing negative effects;

8. the existing silicone insole is not connected to the shoe sole, and the understanding and scene application of the insole is insufficient;

9. the selected materials are not sufficient, and the industrial-grade materials cannot meet the standard of non-toxic application to the human body;

10. the existing silicone insole is treated with ordinary industrial glue, so that the overall thickness is too thick and affects the air permeability;

11. the perforation of the existing silicone insole makes the insole not waterproof, and the increasing dampness causes the shoes to be wet and slippery inside; and 12. composite glues usually do not meet the requirements of non-toxic and environmental protection.

SUMMARY

A purpose of the present disclosure is to provide a silicone insole to solve at least one of the above problems existing in the prior art.

In order to achieve the above purpose, the present disclosure adopts the following technical schemes.

A silicone insole includes a lower insole layer, a polymer adhesive layer, a surface treatment agent layer and an upper silicone flat layer sequentially arranged from bottom to top in that order, the upper silicone flat layer is made of food-grade silicone, and an upper end surface of the upper silicone flat layer is a flat structure without grooves and protrusions.

In an illustrated embodiment of the present disclosure, a material of the surface treatment agent layer includes a coupling agent.

In an illustrated embodiment of the present disclosure, a thickness of the upper silicone flat layer is in a range of 0.5 mm to 2.0 mm.

In an illustrated embodiment of the present disclosure, a material of the polymer adhesive layer includes an environmentally protection glue.

In an illustrated embodiment of the present disclosure, the lower insole layer is made of a food-grade silicone.

Beneficial effects: in the present disclosure, the polymer adhesive layer, the surface treatment agent layer and the upper silicone flat layer can be used as a surface layer of the silicone insole, or can be used as a surface layer alone to directly paste to an original insole, and not change the comfort of the original shoes in terms of weight, thickness, size, etc., it is more convenient to apply in life. A lower end surface of the upper silicone flat layer is combined with the polymer adhesive layer through the surface treatment agent layer, and then integrated with the lower insole layer to form an insole body, which can change a pain point of the existing technology that is easy to fall off, and make an overall connection firmer and more durable. The upper silicone flat layer is made of the food-grade silicone, has advantages such as environmentally protection and non-toxic, and the upper end surface of the upper silicone flat layer is the flat structure without the grooves and protrusions, which can more fully disperse foot pressure, be more suitable for long standing or sporting under the protection of soft food-grade silicone, and suitable for all the current shoes that need insoles to improve the performance. The advantages of the silicone material, such as high friction, waterproof, slightly air permeability, better absorb moisture and perspiration, soft, environmentally protection, non-toxic, odorless, guaranteed rebound touch, quality, ageing resistance, anti-static and technological sense, more excellent wearing comfort, low cost, easy fold, more portable, kept fabric feel, and more practical, can be made full use.

Compared with the prior art, the silicone insole provided by the present disclosure has the following beneficial effects:

1. the silicone material is resistant to high temperature and weather, anti-aging, anti-collision, shock-proof and waterproof, and the surface has excellent affinity;

2. through processing, it can be used in harsh environments without falling off, it has good insulation, high and low temperature resistance, and small compression deformation;

3. using the food-grade and environmentally protection material to ensure non-toxic, odorless, resilient and flexible use, high strength, long service life, pressure resistance, acid and alkali resistance, ageing resistance, and anti-ultraviolet;

4. the surface is flat to maintain the friction force of silicone and increase the affinity between the foot and the shoe;

5. through long-term testing, different schemes of glue treatment are used to maintain its air permeability (the existing insoles are simplified and fully covered by the glue to form an airtight film, which affects air permeability) and moisture-proof;

6. improving shoe cavity environment through waterproof performance, acid and alkali resistance and odorless, deodorization and deodorant;

7. through numerous long-term experiments and practical optimization, innovations from material selection, technology and function, which optimize costs and increase social economic effects;

8. in a global insole field, through independent development and design, the silicone insole with innovative surface improves the quality of domestic insoles and occupies the commanding height of the industry.

Figure 1:
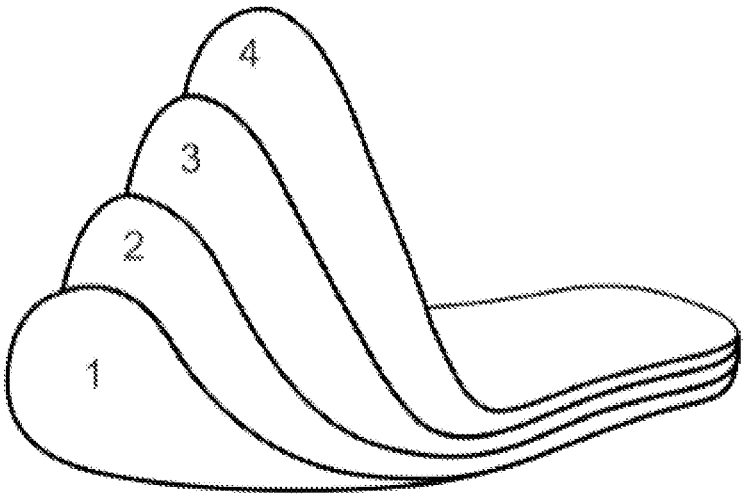
FIG. 1 illustrates a schematic effect diagram of a silicone insole of the present disclosure.
Figure 2:
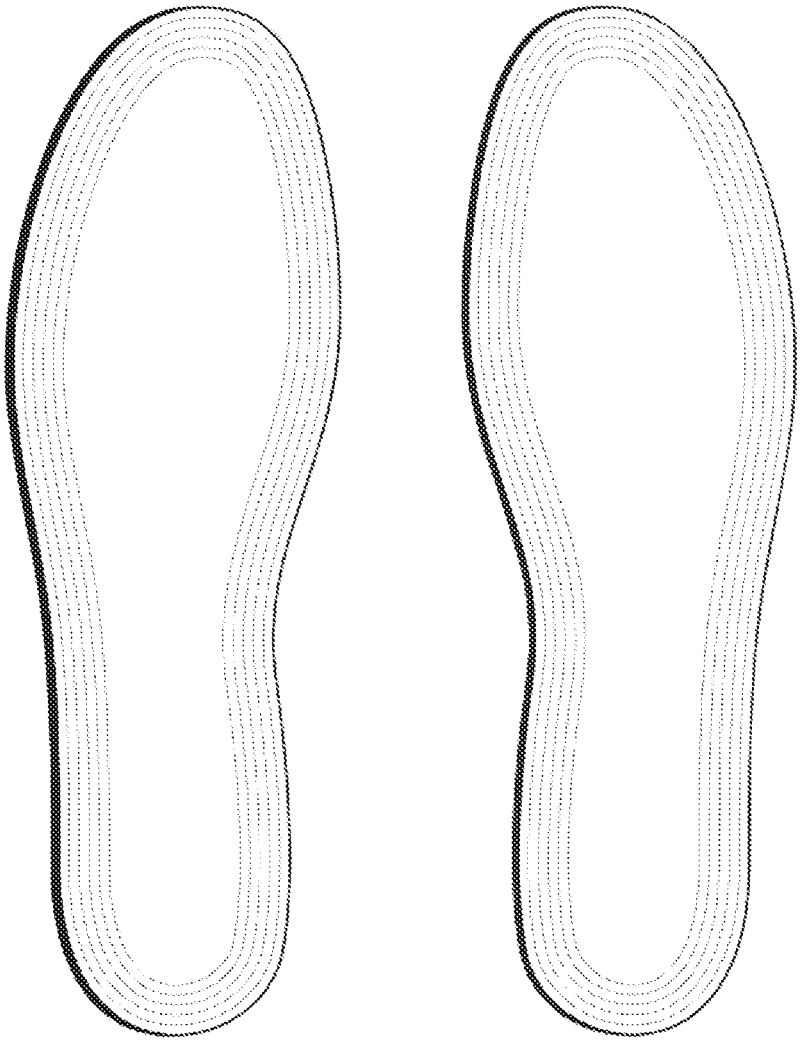
FIG. 2 illustrates a schematic plane diagram of a silicone insole of the present disclosure.

Description of reference numerals: 1-lower insole layer; 2-polymer adhesive layer; 3-surface treatment agent layer; 4-upper silicone flat layer.

DETAILED DESCRIPTION OF EMBODIMENTS

In order to explain the embodiments of the present disclosure or the technical solutions in the prior art more clearly, the present disclosure will be briefly introduced below in combination with the drawings and the description of the embodiments or the prior art. It is obvious that the following description of the structure of the drawings is only some embodiments of the present disclosure. For those skilled in the art, other drawings can be obtained according to these drawings without creative work. It should be noted here that the description of these embodiments is used to help understand the present disclosure, but does not constitute a limitation of the present disclosure.

EMBODIMENT as shown in FIG. 1, an embodiment provides a silicone insole, including a lower insole layer 1, a polymer adhesive layer 2, a surface treatment agent layer 3 and an upper silicone flat layer 4 sequentially arranged from bottom to top in that order, an lower end surface of the upper silicone flat layer 4 is combined with the polymer adhesive layer 2 through the surface treatment agent layer 3, and then integrated with the lower insole layer 1 to form an insole body, which makes an overall connection of the silicone insole firmer and more durable. The upper silicone flat layer 4 is made of a food-grade silicone, and an upper end surface of the upper silicone flat layer 4 is a flat structure without grooves and protrusions, which is suitable for all the current shoes that need insoles to improve the performance, makes full use of the advantages of the silicone material such as high friction, waterproof, slightly air permeability, soft, environmentally protection, non-toxic, odorless, guaranteed rebound touch, quality, ageing resistance, anti-static and technological sense.

In the present disclosure, the polymer adhesive layer 2, the surface treatment layer 3, and the upper silicone flat layer 4 can be used as an surface layer of the silicone insole, or can be used as a surface layer alone to directly paste to an original insole, and the shoe cavity/shoe inside space does not change in terms of weight, thickness, size, etc., which maintains the comfortable design of the original shoes, is more convenient to apply in life. The lower end surface of the upper silicone flat layer 4 is combined with the polymer adhesive layer 2 through the surface treatment agent layer 3, and then integrated with the lower insole layer 1 to form an insole body, which can change a pain point of the existing technology that is easy to fall off, and make the overall connection firmer and more durable; the upper silicone flat layer 4 is made of the food-grade silicone, has advantages such as environmental protection and non-toxic, the upper end surface of the upper silicone flat layer 4 is the flat structure without the grooves and the protrusions, which can more fully disperse foot pressure, be more suitable for long standing or sporting under the protection of soft food-grade silicone and suitable for all the current shoes that need insoles to improve the performance, and make full use of the advantages of silicone materials such as high friction, waterproof, slightly air permeability, better absorb moisture and perspiration, soft, environmentally protection, non-toxic, odorless, guaranteed rebound touch, quality, ageing resistance, anti-static and technological sense, more excellent wearing comfort, low cost, easy fold, more portable, kept fabric feel, and more practical.

Compared with the prior art, the silicone insole provided by the present disclosure has the following beneficial effects:

1. silicone material has high temperature and weather resistance, ageing resistance, anti-collision, shock-proof, waterproof, and its surface has excellent affinity;

2. through processing, it can be used in harsh environments without falling off, in addition, it has good insulation, high and low temperature resistance, and small compression deformation;

3. using food-grade environmentally protection materials to ensure non-toxic, odorless, resilient and flexible use, high strength, long service life, pressure resistance, acid and alkali resistance, ageing resistance, and anti-ultraviolet;

4. the surface is flat to maintain the friction force of silicone and increase the affinity between the foot and the shoe;

5. through long-term testing, different schemes of glue treatment are used to maintain its air permeability (the existing insoles are simplified and fully covered by the glue to form an airtight film, which affects air permeability) and moisture-proof;

6. improving shoe cavity environment through waterproof performance, acid and alkali resistance, odorless and deodorization 7. through numerous long-term experiments and practical optimization, innovation from material selection, technology and function, which optimizes costs and increases social economic effects;

8. in the global insole field, through independent development and design, the silicone insole with innovative flat improves the quality of silicone insoles and occupies commanding heights of the industry.

As an illustrated embodiment, it should be further explained that a material of the surface treatment agent layer 3 includes a coupling agent, the coupling agent can be combined with the polymer adhesive layer 2 to make the adhesion of the lower insole layer 1 and the upper silicone flat layer 4 firmer and not easy to fall off.

As an illustrated embodiment, it should be further explained that a thickness of the upper silicone flat layer 4 is in a range of 0.5 mm to 2.0 mm, the upper silicone flat layer 4 retains the air permeability of the silicone, increases the insole function, and improves the environment inside the shoe.

As an illustrated embodiment, it should be further explained that a material of the polymer adhesive layer 2 includes an environmentally protection glue, the environmentally protection glue can meet the requirements of non-toxic environmental protection, and improve the quality of insoles.

As an illustrated embodiment, it should be further explained that the lower insole layer 1 is made of the food-grade silicone, which is environmentally protection, non-toxic and comfortable.

Finally, it should be noted that the above description is only the exemplary embodiments of the present disclosure, but the protection scope of the disclosure is not limited to this. Any modification, equivalent replacement and improvement made within the spirit and principles of the present disclosure shall be included in the protection scope of the present disclosure.

What is claimed is:

1. A silicone insole, comprising: a lower insole layer, a polymer adhesive layer, a surface treatment agent layer and an upper silicone flat layer sequentially arranged from bottom to top in that order, wherein both of the upper silicone flat layer and the lower insole layer are made of a food-grade silicone, and an upper end surface of the upper silicone flat layer is a flat structure without grooves and protrusions;

wherein a material of the surface treatment agent layer comprises a coupling agent, which is combined with the polymer adhesive layer to make the lower insole layer and the upper silicone flat layer be sticked together.

2. The silicone insole according to claim 1, wherein a thickness of the upper silicone flat layer is in a range of 0.5 mm to 2.0 mm.

3. The silicone insole according to claim 1, wherein a material of the polymer adhesive layer comprises an environmentally protection glue.

4. A silicone insole, comprising: an upper silicone layer and a lower insole layer;

wherein a lower end surface of the upper silicone layer is combined with a polymer adhesive layer through a surface treatment agent layer and thereby the polymer adhesive layer, the surface treatment agent layer and the upper silicone layer together form a surface layer of the silicone insole, and the surface layer as a whole is integrated with the lower insole layer to together form an insole body;

wherein an upper end surface of the upper silicone layer is a flat structure, and the upper silicone layer is made of a food-grade silicone;

wherein a thickness of the upper silicone layer is in a range of 0.5 mm to 2.0 mm to retain air permeability of silicone, a material of the surface treatment agent layer comprises a coupling agent, and the coupling agent is combined with the polymer adhesive layer to improve adhesion of the lower insole layer and the upper silicone layer.

5. The silicone insole according to claim 4, wherein the lower insole layer is an original insole, and the surface layer is directly pasted to the original insole.

6. The silicone insole according to claim 4, wherein the lower insole layer is made of the food-grade silicone, and thereby both of the upper silicone layer and the lower insole layer are made of the food-grade silicone.

* * * * *